US007113730B2

(12) United States Patent
Park et al.

(10) Patent No.: US 7,113,730 B2
(45) Date of Patent: Sep. 26, 2006

(54) APPARATUS FOR PREVENTING DEVELOPER WRAPAROUND IN WET ELECTROPHOTOGRAPHIC PRINTER

(75) Inventors: Geun-yong Park, Suwon (KR); Woo-yong Park, Suwon (KR); Yong-su Kim, Yongin (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 167 days.

(21) Appl. No.: 10/610,797

(22) Filed: Jul. 2, 2003

(65) Prior Publication Data

US 2004/0005174 A1 Jan. 8, 2004

(30) Foreign Application Priority Data

Jul. 3, 2002 (KR) ..... 10-2002-0038471
Feb. 5, 2003 (KR) ..... 10-2003-0007279

(51) Int. Cl.
*G03G 15/10* (2006.01)

(52) U.S. Cl. ..... 399/237; 399/239

(58) Field of Classification Search ..... 399/237, 399/57, 53, 239, 249
See application file for complete search history.

(56) References Cited

U.S. PATENT DOCUMENTS 3,830,419 A * 8/1974 Lee ..... 226/184
4,258,648 A * 3/1981 Leising et al. ..... 118/60
6,167,225 A * 12/2000 Sasaki et al. ..... 399/237
6,640,073 B1 * 10/2003 Kurotori et al. ..... 399/237

FOREIGN PATENT DOCUMENTS

| | | | |
|---|---|---|---|
| JP | 03102369 A | * | 4/1991 |
| JP | H07-181811 | | 7/1995 |
| JP | 07271178 A | * | 10/1995 |
| JP | 10-288886 | | 10/1998 |
| KR | 2000-038475 | | 7/2000 |
| KR | 2000-056601 | | 9/2000 |
| KR | 2001-058655 | | 7/2001 |
| KR | 2001058655 A | * | 7/2001 |

OTHER PUBLICATIONS

Office Action issued on Nov. 29, 2004, from the Korean Patent Office with respect to Korean Patent Application No. 10-2003-0007279, filed Feb. 5, 2003.

* cited by examiner

*Primary Examiner*—Quana Grainger
(74) *Attorney, Agent, or Firm*—Staas & Halsey LLP

(57) ABSTRACT

An apparatus prevents developer wraparound in a wet electrophotographic printer using wraparound preventing units. Each of the wraparound preventing units has varied diameter parts formed at both ends of a developing roller, and matching parts formed at both ends of a metering roller to correspond to the varied diameter parts of the developing roller. Since the varied diameter parts and the matching parts are respectively installed at both ends of the developing roller and the metering roller, developer wraparound is not generated in the developing roller and a photosensitive roller during development.

18 Claims, 13 Drawing Sheets

APPARATUS FOR PREVENTING DEVELOPER WRAPAROUND IN WET ELECTROPHOTOGRAPHIC PRINTER

CROSS-REFERENCE TO RELATED APPLICATIONS

This application claims the benefit of Korean Application No. 2002-38471 and 2003-7279, filed Jul. 3, 2002 and Feb. 5, 2003, respectively, in the Korean Intellectual Property Office, the disclosure of which is incorporated herein by reference.

BACKGROUND OF THE INVENTION

1. Field of the Invention

The present invention relates to a wet electrophotographic printer using a high density liquid developer, and in particular, to an apparatus for preventing wraparound in a wet electrophotographic printer which can prevent developer wraparound in a developing roller and a photosensitive body during development.

2. Description of the Related Art

In general, an electrophotographic printer obtains a desired image by forming an electrostatic latent image on a photosensitive medium or body such as a photosensitive belt or drum, developing the electrostatic latent image by using developers having predetermined colors, and transferring the developed image to paper. The electrophotographic printer is divided into a wet type and a dry type according to a kind of developer. The wet electrophotographic printer employs a liquid developer obtained by mixing a volatile liquid carrier with a powder type toner.

Since the wet electrophotographic printer using the liquid developer utilizes a toner having a grain size below about 0.5 to 5 μm, the wet electrophotographic printer obtains higher quality image than an image formed by the dry electrophotographic printer using the powder type toner in development of the electrostatic latent image, and prevents damage due to harmful toner dusts. Therefore, the wet electrophotographic printer has gradually become popular.

However, the wet electrophotographic printer obtains an appropriate image density by using a low density liquid developer, the density generally being below 3% solid. Accordingly, a complicated developer delivery system to supply sufficient liquid developer to a developing region of a developing apparatus and collecting the developer is required to obtain the appropriate image density, thus increasing a bulk of the developing apparatus and complicating the system.

In addition, an apparatus to control a density of the liquid developer is necessary to obtain the appropriate image density when replenishing the developer due to variations of toner grains after the development.

Therefore, the developer delivery system needs to be removed or simplified to prevent the wet electrophotographic printer from being oversized or excessively complicated. Accordingly, the wet electrophotographic printer that uses a high density liquid developer over 3% solid, rather than a low density liquid developer below 3% solid, has been more polular.

FIG. 1 is a schematic view illustrating a general electrophotographic printer using a high density liquid developer.

The wet electrophotographic printer includes a photosensitive body 9 such as an organic photoconductive (OPC) drum, a laser scanning unit 11, a charged roller 12, a developing apparatus 13, a transfer belt 10 moving on a caterpillar-like photosensitive belt, primary and secondary rollers 21 and 22 for rotating the transfer belt 10 on the photosensitive belt, a first transfer roller 8 for transferring an image to the transfer belt 10, a second transfer roller 23 for transferring the image to paper P, a fixing roller 25 for fixing the image, and a cleaning blade 51 for removing a residual image from the transfer belt 10. The constitutional elements of the printer sequentially perform an image formation process including charging, exposure, development, transfer and fixation by mutual operations, to form a wanted image on the paper P.

In general, a color printer includes four laser scanning units 11 for color printing, and four developing apparatuses 13 for individually containing high density liquid developers 48 of 3 to 40% solid, which have four colors, namely black, yellow, cyan and magenta.

As illustrated in FIG. 2, each of the developing apparatuses 13 includes a storing unit 6 for storing the high density liquid developer 48, a developing roller 7 positioned below the photosensitive body 9, a deposit roller 14 installed below the developing roller 7 for transmitting an electric force to the liquid developer 48 to form a charged developer layer on the developing roller 7, a metering roller 15 for transmitting a predetermined voltage to the charged developer layer formed on the developing roller 7 by the deposit roller 14 to adhere a large volume of toner to the developing roller 7, and restricting the charged developer layer to a predetermined toner amount or density (% solid) to be supplied into a nip between the developing roller 7 and the photosensitive body 9, and a cleaning roller 16 for cleaning the developing roller 7.

The deposit roller 14 and the metering roller 15 serve to supply a predetermined toner amount or density of developer layer into the nip between the developing roller 7 and the photosensitive body 9, regardless of a density of the high density liquid developer 48 having 3 to 40% solid, or the liquid developer 48 having a density that varies during use.

The operation of the wet electrophotographic printer is explained below.

According to a print command, an electric charge layer, namely an electrostatic latent image corresponding to an image to be printed is formed on the photosensitive body 9 by the charged roller 12 and the laser scanning unit 11. A predetermined amount of toner of the developer layer formed on the developer roller 7 is adhered to the electrostatic latent image region from the liquid developer 48 of the storing unit 6 by the deposit roller 14 and the metering roller 15, thus forming a toner image.

Here, the liquid developer 48 is formed as a charged developer layer on the developing roller 7 due to an electric force from the deposit roller 14, and formed as a predetermined toner amount of a developer layer on the developing roller 7 due to a predetermined voltage from the metering roller 15.

The image formed on the photosensitive body 9 by the developing apparatus 13 is first transferred from the photosensitive body 9 to the transfer belt 10 due to a voltage and pressure of the first transfer roller 8 positioned inside the transfer belt 10. Since the transfer belt 10 is rotated by the primary and secondary rollers 21 and 22, the image transferred to the transfer belt 10 is moved to the second transfer roller 23 and then is transferred to the paper P due to a voltage and pressure of the second transfer roller 23.

The image transferred to the paper P is fixed to the paper P by the fixing roller 25 and a fixing backup roller 26, thus forming a desired image.

After the image transferred to the transfer belt 10 is transferred to the paper P, the transfer belt 10 is continuously rotated by the primary and secondary rollers 21 and 22 and moved to the cleaning blade 51 installed to contact the image formation side of the transfer belt 10 at the side of the primary roller 21. Here, residual developer sediments (generally 90 to 98% of developer is transferred to the paper) are removed from the surface of the transfer belt 10 by the cleaning blade 51 for succeeding image printing, and collected in a used developer storing unit 52.

The transfer belt 10 from which the residual developer sediments are removed repeats the aforementioned procedure to perform the succeeding electrostatic latent image formation and development through the photosensitive body 9, the laser scanning unit 11 and the developing apparatus 13.

However, as shown in FIGS. 3A to 3C, the conventional printer has a structure wherein the outer surfaces of the metering rollers 15, 15' and 15" for varying the charged developer layers formed on the developing rollers 7, 7' and 7" by the deposit roller 14 into the predetermined toner amount or density of developer layer and the outer surfaces of the developing rollers 7, 7' and 7" touch each other.

Accordingly, as shown in FIG. 4, in a state wherein the charged developer layer is formed on the developing roller 7 by the deposit roller 14, when the metering roller 15 forms the nip with the developing roller 7 and restricts the charged developer layer to have a predetermined toner density by rotation, the liquid developer 48 pushed toward both side surfaces of the metering roller 15 is collected in the space between the metering roller 15 and the developing roller 7 where the developer layer 17 restricted to have a predetermined density by the nip between the developing roller 7 and the metering roller 15 is positioned. At the worst, the liquid developer 48 is transferred to the photosensitive body 9 through the developing roller 7 to form wraparound 18, thus partially or wholly supplying the toner over a predetermined amount or density into the nip between the developing roller 7 and the photosensitive body 9.

As described above, the toner over a predetermined amount or density supplied into the nip between the developing roller 7 and the photosensitive body 9 reduces a quality of the image. In addition, after the image is transferred to the paper P, the toner is left on the surface of the photosensitive body 9, increasing the developer segments collected in the used developer storing unit 52 by the cleaning blade 51. Therefore, consumption of the developer is unnecessarily increased.

Referring to FIG. 5A through FIG. 5C, a developing apparatus of another conventional wet electrophotographic printer is illustrated using a squeezing unit squeezing a developer transferred on a latent image region of a photosensitive body to change a toner contained in the developer into an image film and to remove a carrier except for the toner contained in the developer when excess developer is supplied on the photosensitive body. The developing apparatus is disclosed at Korean patent laid-open No. 2000-56601 of Lee youn Keun et al., filed on Feb. 24, 1999 and laid open on Sep. 15, 2000 in the title of "A Squeezing Unit of Wet Electrophotographic Printer".

In the developing apparatus, the squeezing unit 27 comprises a squeeze roller 28 disposed to come in contact with a photosensitive body 9' such as a photosensitive belt and away from a developing roller 7'" to be driven by the photosensitive body 9' during development, and a blade 30 disposed to be separable from squeeze roller 28 to remove a drip line 33 (FIG. 5C) forming on the photosensitive body 9' when the squeeze roller 28 is rotated in a direction opposite to a rotation direction of the photosensitive body 9' to remove the developer remaining on the photosensitive body 9' after development.

The squeeze roller 28 has taper portions 29 formed at both ends thereof to prevent a wraparound generating between the blade 30 and the squeeze roller 28 when the drip line 33 is removed by the blade 30, from being transferred to the photosensitive body 9'.

However, in the developing apparatus of the conventional printer, the squeezing unit 27 needs a separate blade 30 and is disposed away from the developing roller 7'". Also, the photosensitive body 9' is formed of a photosensitive belt. Accordingly, the printer is oversized or excessively complicated.

SUMMARY OF THE INVENTION

Additional aspects and advantages of the invention will be set forth in part in the description which follows and, in part, will be obvious from the description, or may be learned by practice of the invention.

It is, therefore, an aspect of the present invention to provide an apparatus for preventing wraparound in a wet electrophotographic printer having a relatively simple structure. In the present invention, both ends of a developing roller come in compressive contact with both ends of a metering roller to restrict a developer wraparound from being generated therebetween, but do not come in contact with a photosensitive body. Thus, even though a small amount of developer wraparound is generated between both ends of the developing roller and the metering roller, the developer wraparound is not transferred to the photosensitive body, but is withdrawn toward the metering roller. Hence, the developer wraparound is prevented from being formed in the developing roller and the photosensitive body during development.

To achieve the above and/or other aspects, an apparatus prevents developer wraparound in a wet electrophotographic printer, the apparatus comprising a developer storing space to store a liquid developer; a photosensitive body to form a latent image; a developer transfer body rotated to face the photosensitive body, to transfer the developer from the developer storing space to the photosensitive body to form a visible image according to the latent image, the developer transfer body comprising a first portion having a first diameter which is substantially constant, and a second portion extended beyond at least one of both ends of the first portion along a longitudinal axis of the developer transfer body and having a varied diameter composed of a plurality of second diameter portions smaller than the first diameter; and at least one developing density restricting roller to restrict at least one of amount and density of toner particles of the liquid developer supplied to the developer transfer body, the developing density restricting roller being constructed to have a shape conforming to the developer transfer body.

In an embodiment, the developer transfer body is formed in a roller shape, and at least a portion of the second portion is tapered at a predetermined angle toward a corresponding end of the developer transfer body to prevent the at least portion of the second portion from being in contact with the photosensitive body. Alternatively, at least a portion of the second portion may be formed to have a shape selected from a shape that is tapered in a saw tooth or a wave pattern, a shape that is tapered in a convex pattern, a shape that is tapered in a concave pattern, a shape that is tapered in a step pattern, a shape that is tapered and bent in a jar pattern, and a shape that is tapered in more than a two angled frustum-of-cone pattern.

The developing density restricting roller may comprise at least one end portion formed to have a shape conforming to the second portion of the developer transfer body to make a compressive contact therebetween.

The second portion may be terminated at the second diameter portion of the varied diameter positioned at a spot where the second portion and the at least one end portion of the developing density restricting roller cease to make a contact. The at least one end portion of the developing density restricting roller may comprise an extended surface portion formed to have one of a diameter equal to, a diameter smaller than, and a varied diameter smaller than a third diameter of the at least one end portion of the developing density restricting roller corresponding to the second diameter of the varied diameter portion positioned at the spot where the second portion and the at least one end portion of the developing density restricting roller cease to make a contact.

Also, the at least one end portion of the developing density restricting roller may be formed of an elastic material.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
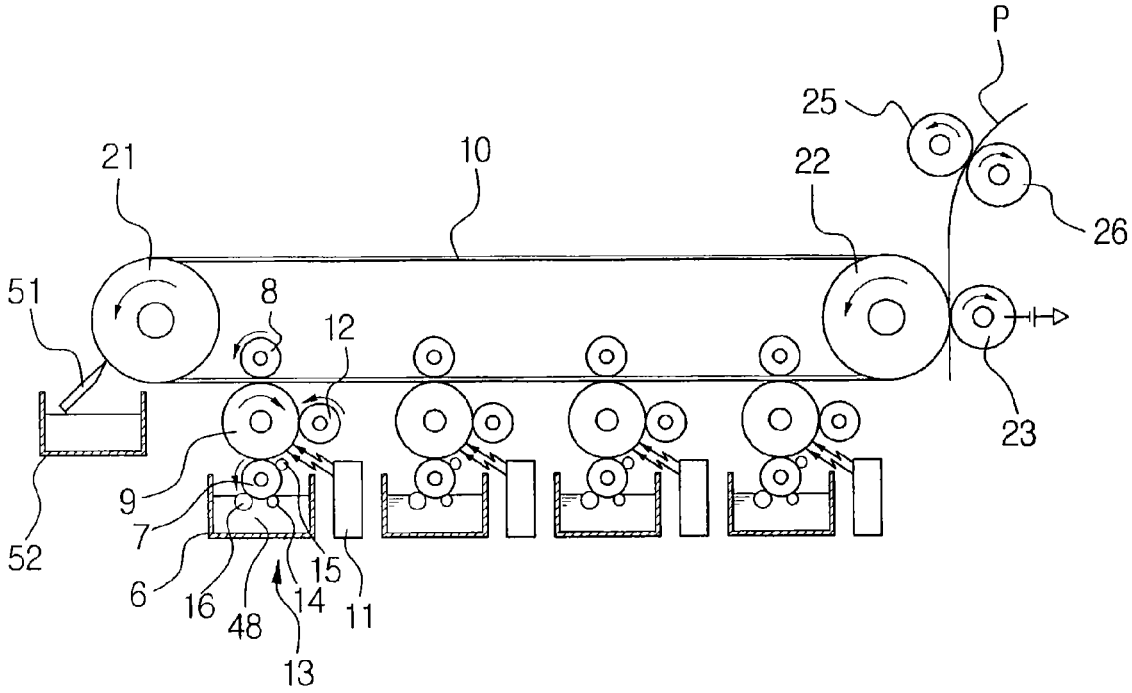
FIG. 1 (PRIOR ART)
FIG. 1 is a schematic view illustrating a general wet electrophotographic printer as is known in the art.
Figure 2:
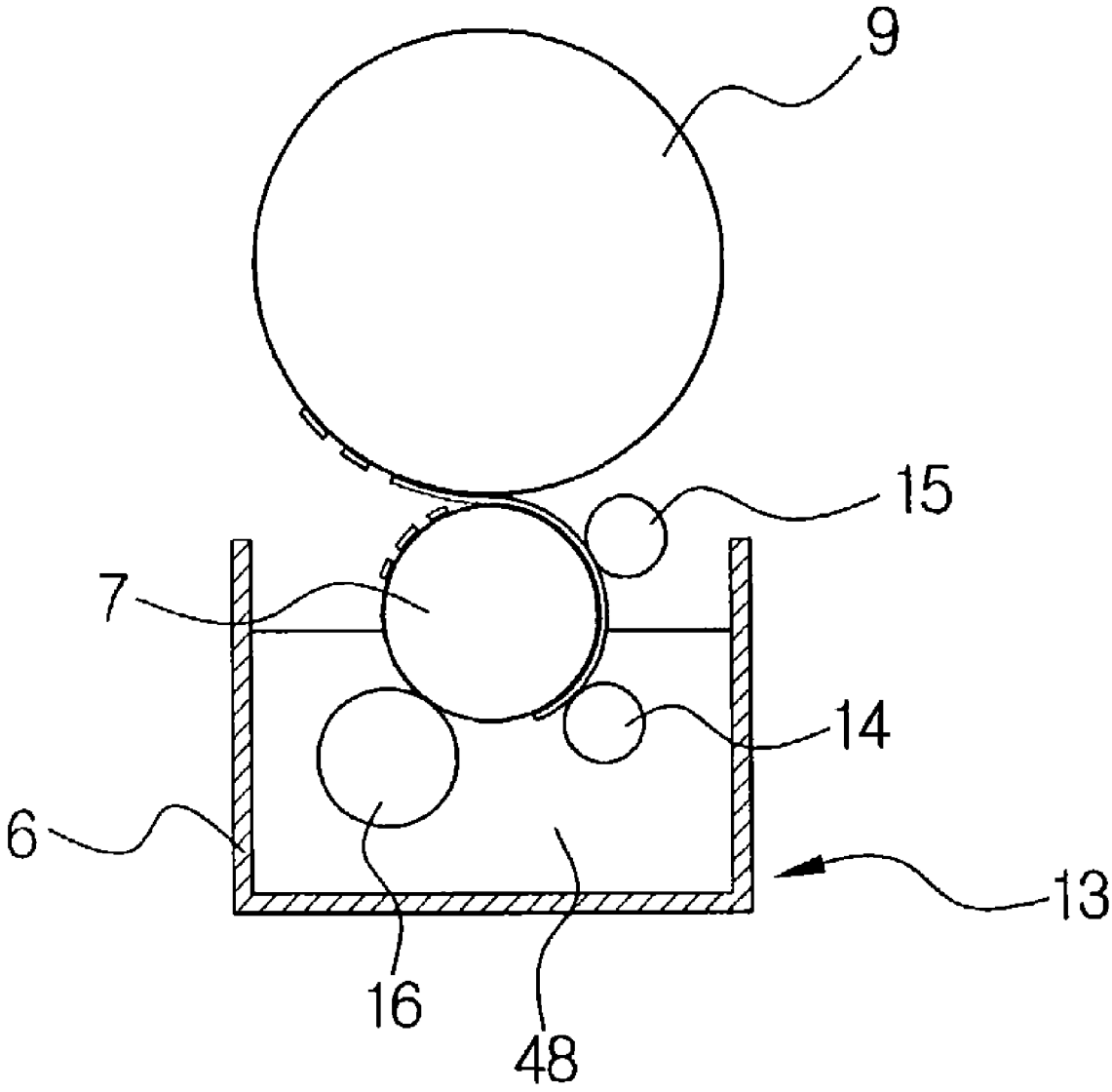
FIG.2 (PRIOR ART)
FIG. 2 is a schematic view illustrating a developing apparatus and a photosensitive body of the wet electrophotographic printer of FIG. 1.
Figure 3A:
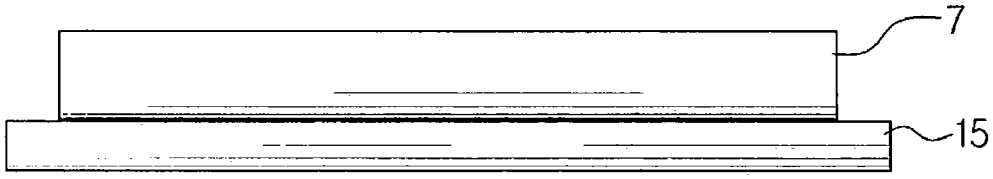
FIG.3A (PRIOR ART)
FIGS. 3A through 3C are schematic views respectively illustrating installation examples of a developing roller and a metering roller of the developing apparatus of the wet electrophotographic printer of FIG. 1.
Figure 3B:
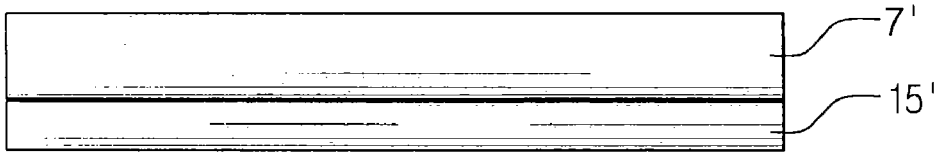
FIG.3B (PRIOR ART)
Figure 3C:
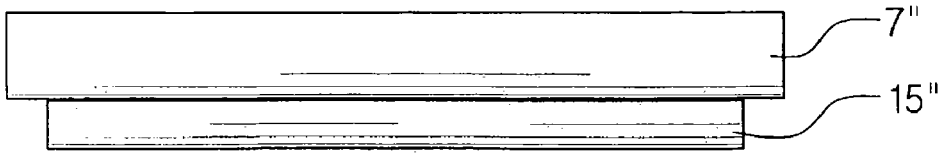
FIG.3C (PRIOR ART)
Figure 4:
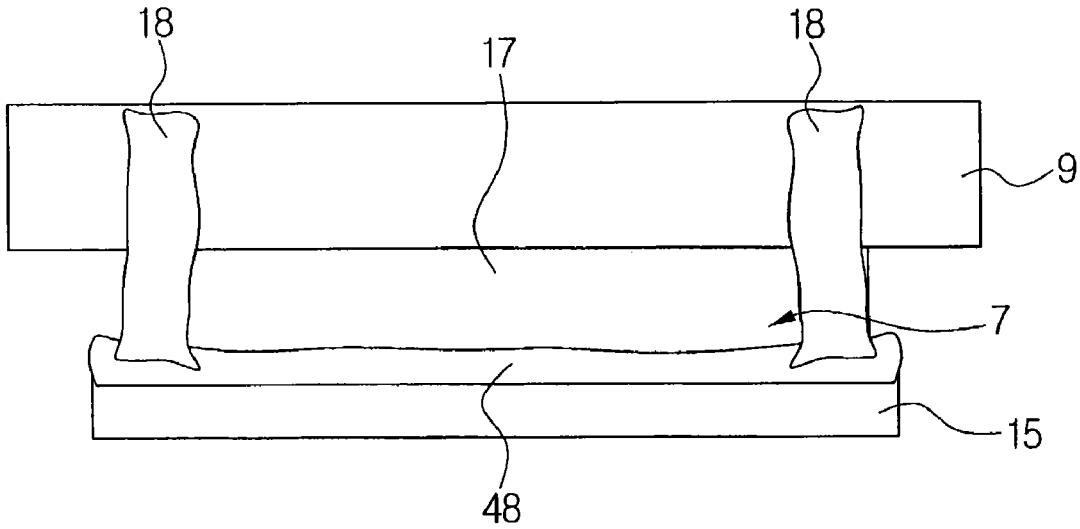
FIG.4 (PRIOR ART)
FIG. 4 is a schematic view illustrating wraparound generated in the installation example of the developing roller and the metering roller of FIG. 3A.
Figure 5A:
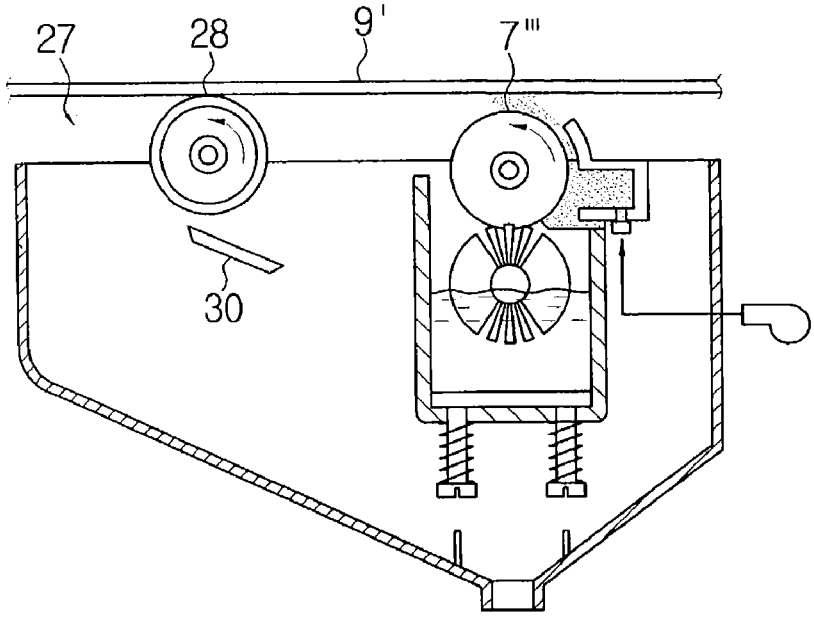
FIG.5A (PRIOR ART)
FIGS. 5A through 5C are a cross-sectional view, a partial perspective view, and a partial cross-sectional view of a developing apparatus of another conventional wet electrophotographic printer having a squeezing unit.
Figure 5B:
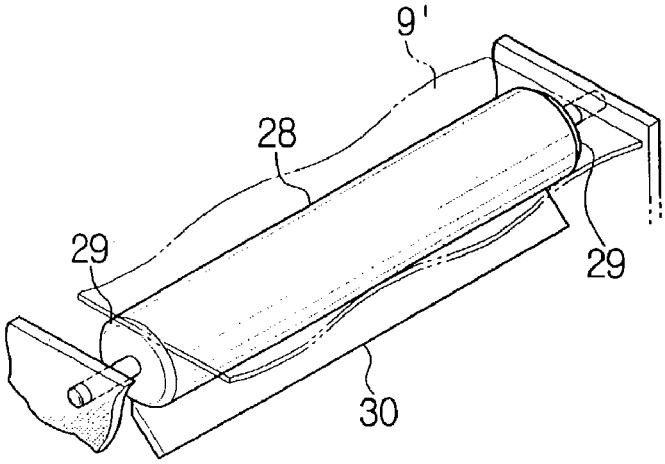
FIG.5B (PRIOR ART)
Figure 5C:
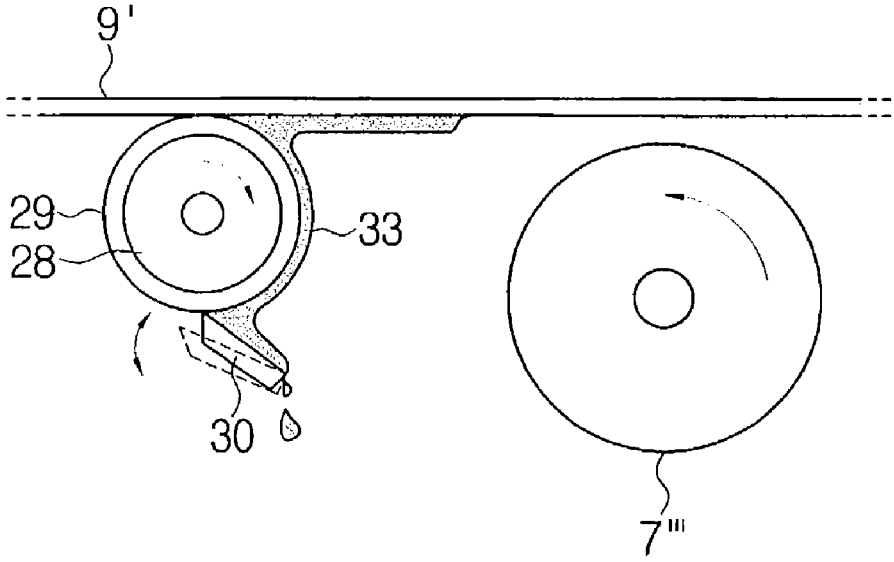
FIG.5C (PRIOR ART)

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

An embodiment of the present invention will now be described with reference to the accompanying drawings. The matters defined in the description, such as a detailed construction and,elements of a circuit are provided to assist in a comprehensive understanding of the invention. Thus, it is apparent that the present invention may be carried out without the defined matters. Also, well-known functions or constructions are not described in detail to prevent obscuring the invention by providing unnecessary detail.

Figure 6:
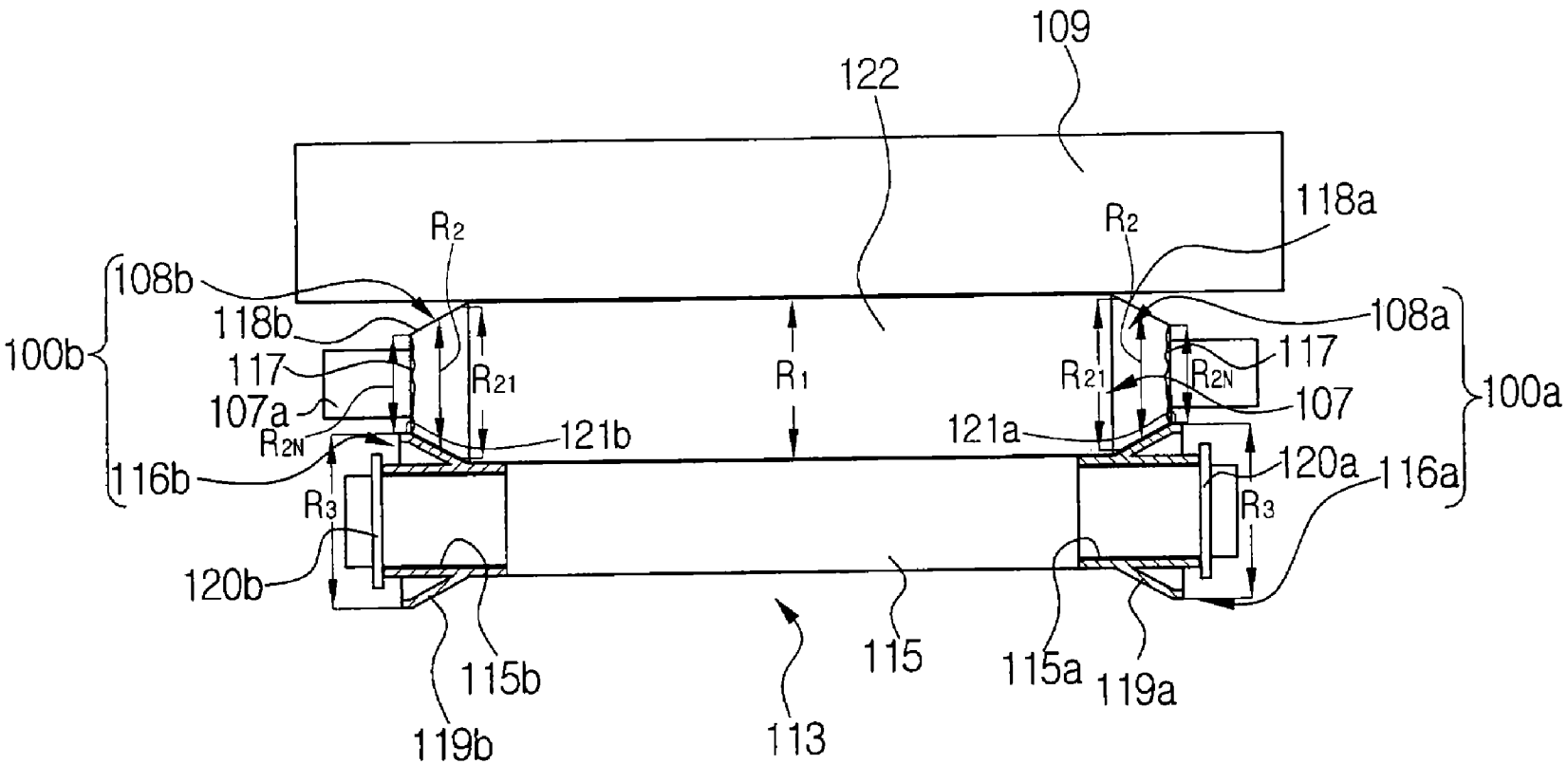
FIG. 6 is a schematic view illustrating a developing apparatus and a photosensitive body of a wet electrophotographic printer using an apparatus for preventing developer wraparound in accordance with an embodiment of the present invention.
Figure 7A:
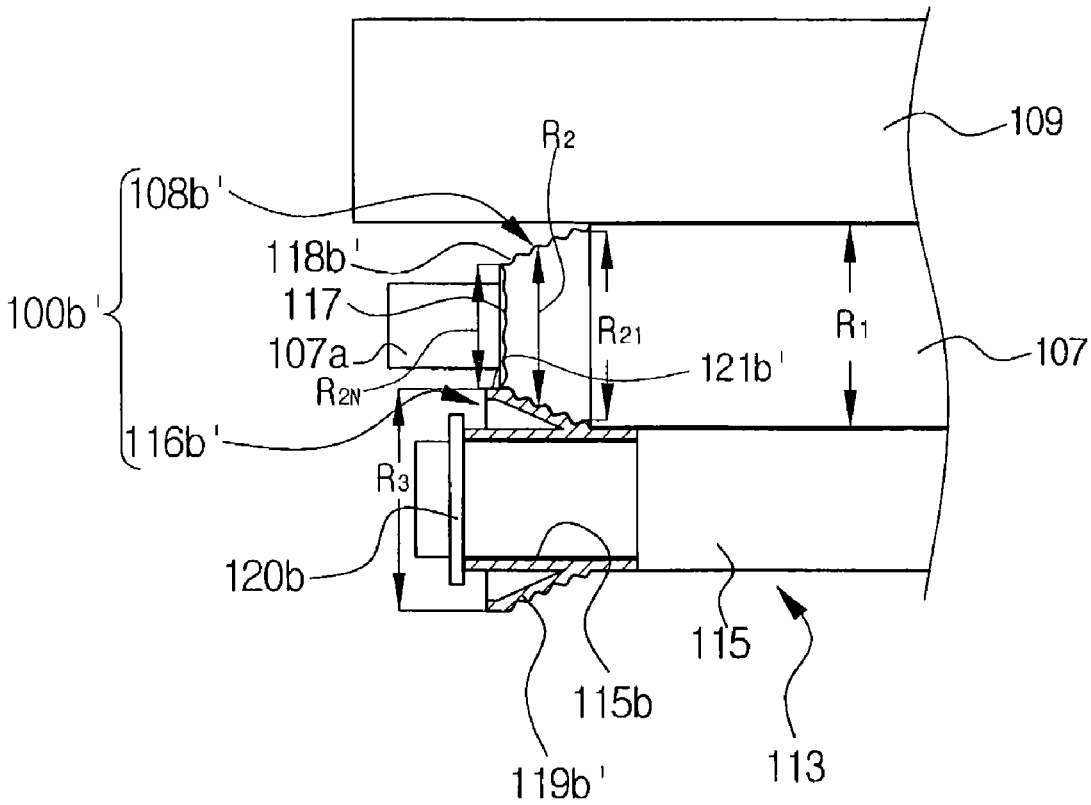
FIGS. 7A through 7F are partial schematic views of modified wraparound preventing units of the apparatus for preventing developer wraparound in accordance with the present invention.
Figure 7B:
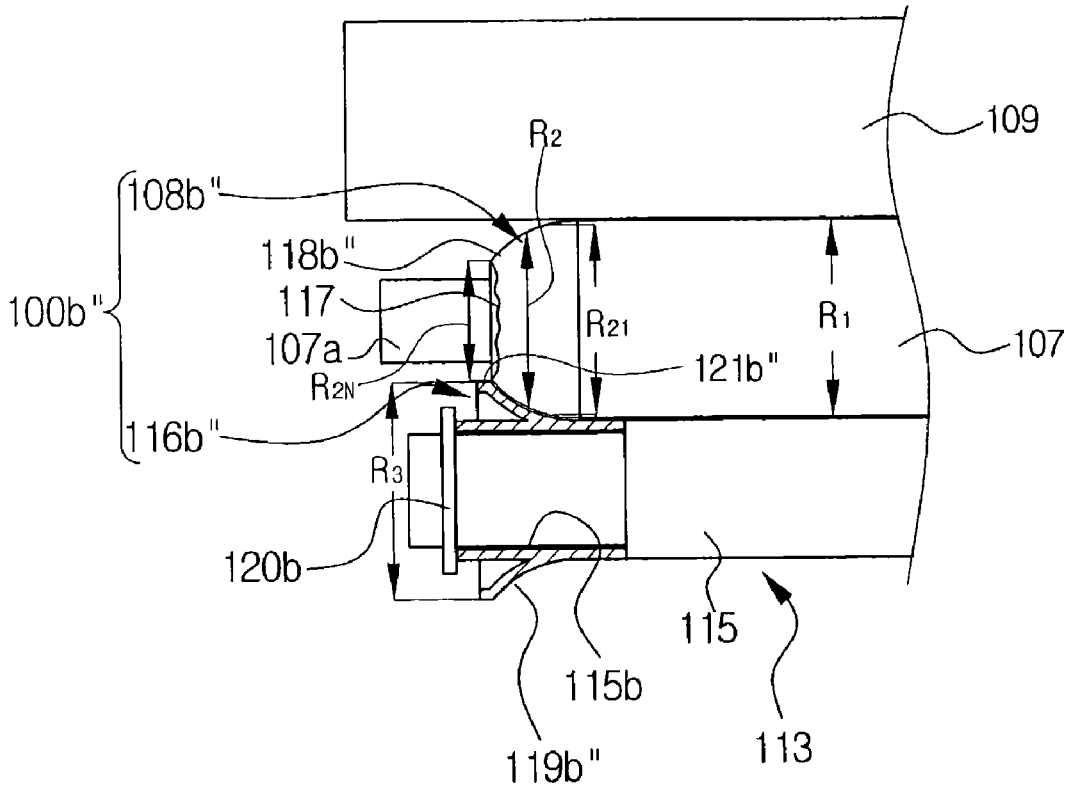
Figure 7C:
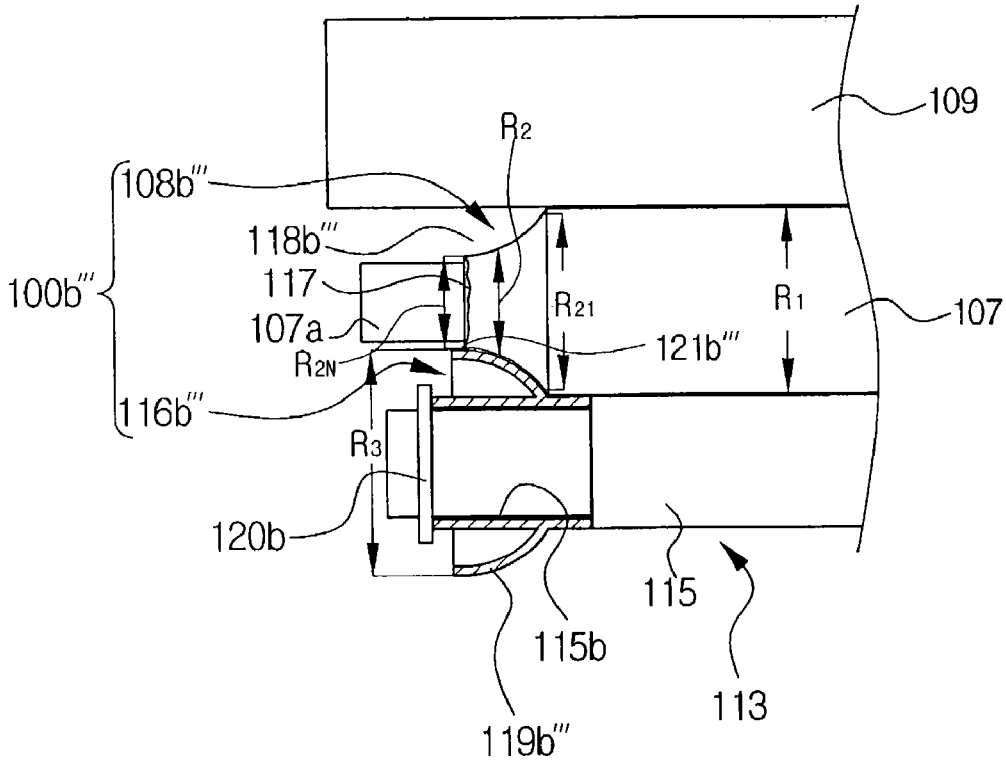
Figure 7D:
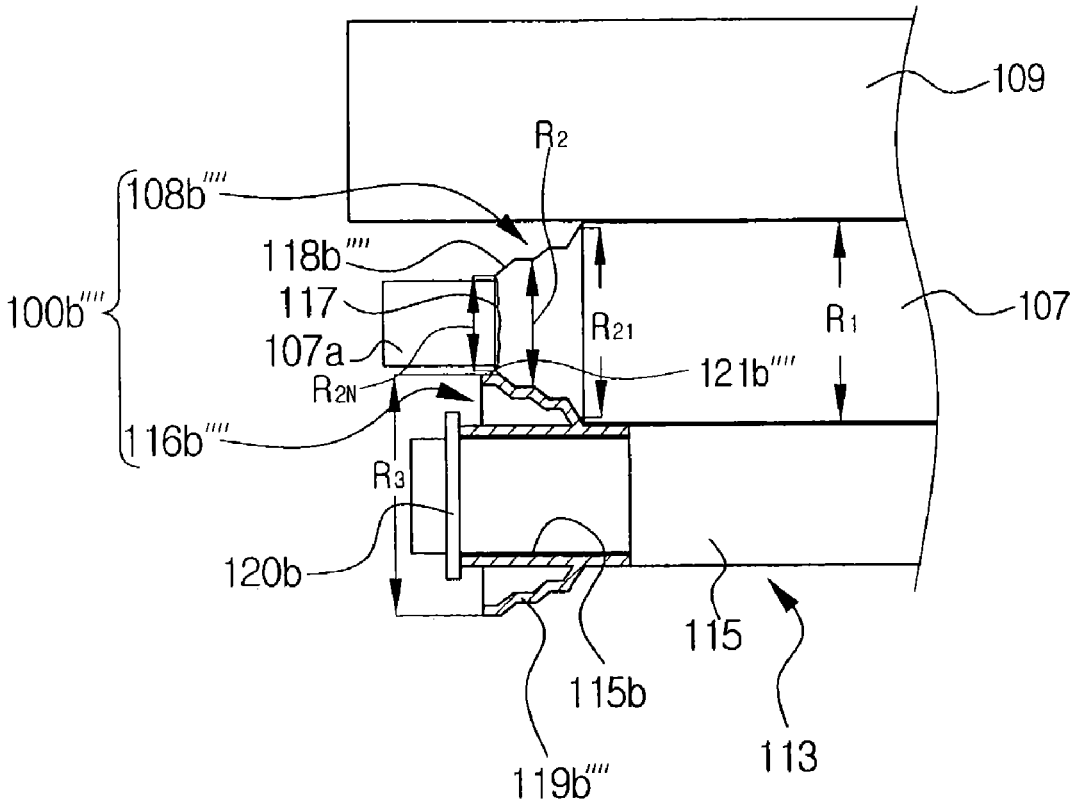
Figure 7E:
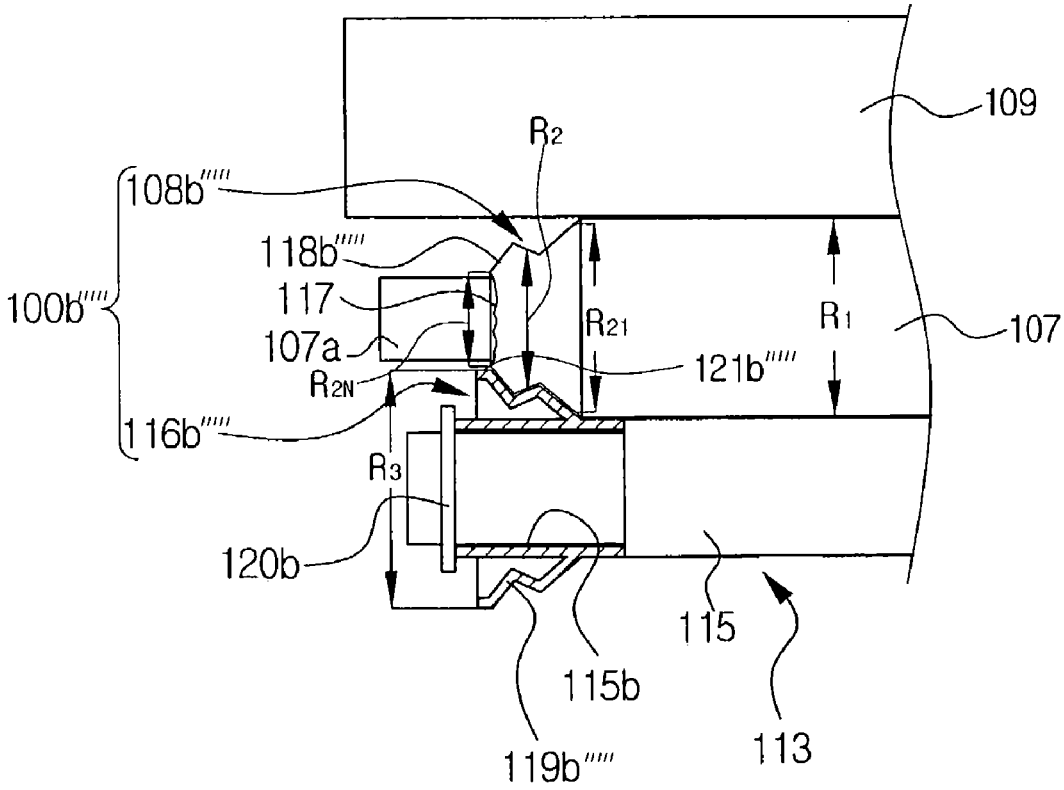
Figure 7F:
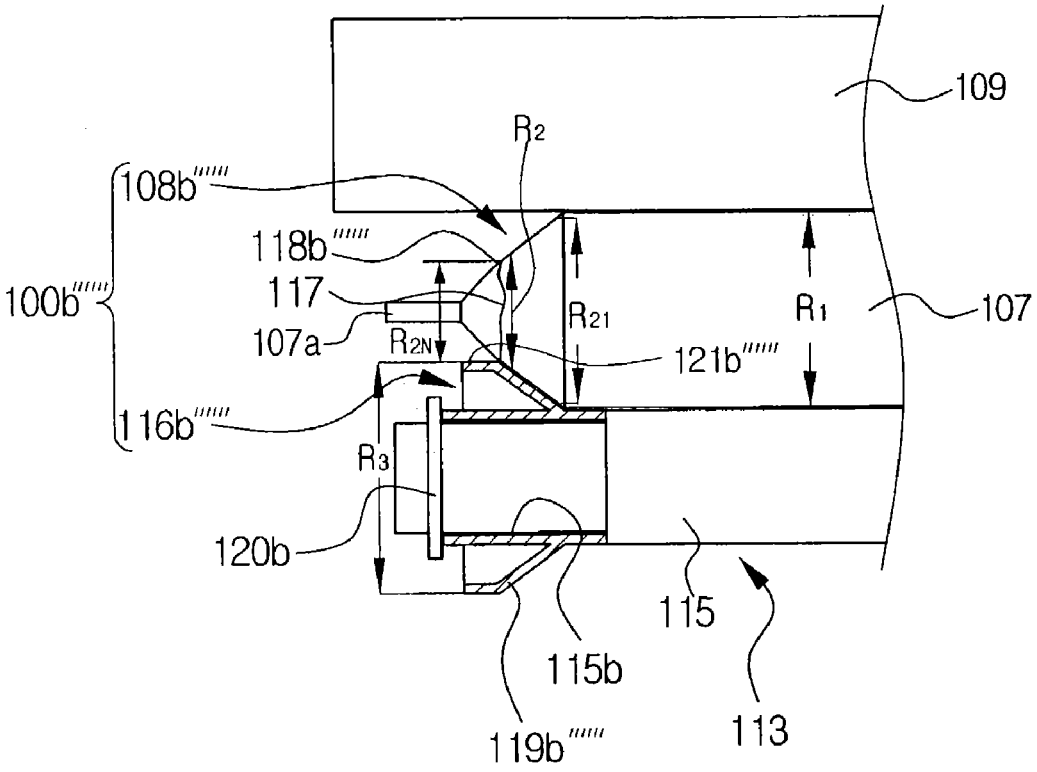

FIG. 6 is a schematic view partially illustrating a developing apparatus 113 and a photosensitive body 109 of a wet electrophotographic printer using an apparatus 100 for preventing developer wraparound in accordance with an embodiment of the present invention.

Identically to the developing apparatus 13 of FIG. 1, the developing apparatus 113 includes a storing unit (not shown) for storing a high density liquid developer, a developing roller 107 positioned below a photosensitive body 109, a deposit roller (not shown) installed below the developing roller 107 to transmit an electric force to the liquid developer to form a charged developer layer on the developing roller 107, a metering roller 115 to transmit a predetermined voltage to the charged developer layer formed on the developing roller 107 by the deposit roller (not shown) to adhere a large volume of toner to the developing roller 107, and to restrict the charged developer layer to have a predetermined toner amount or density to be supplied into a nip between the developing roller 107 and the photosensitive body 109, and a cleaning roller (not shown) to clean the developing roller 107.

The deposit roller and the metering roller 115 serve to supply a predetermined developing density of developer layer into the nip between the developing roller 107 and the photosensitive body 109, regardless of the high density liquid developer of 3 to 40% solid or a density of the liquid developer that varies in use.

The apparatus 100 for preventing developer wraparound includes two wraparound preventing units 100*a* and 100*b* installed respectively at both ends of the developing roller 107 and the metering roller 115.

Each of the wraparound preventing units 100*a* and 100*b*, for example, the wraparound preventing unit 100*a* shown at the right side of FIG. 6 includes a varied diameter part 108*a*, extended beyond a right end of cylindrical surface 122 of the developing roller 107 having a first diameter $R_1$, which is substantially constant, and is parallel to the photosensitive body 109, and a matching part 116*a* formed at corresponding right end of the metering roller 115 to have a shape conforming to the varied diameter part 108*a*, and thus is in compressive contact with the varied diameter part 108*a*, to prevent wraparound during the development.

The varied diameter part 108*a* has a varied diameter $R_2$ comprising a plurality of second diameter portions $R_{21}$–$R_{2N}$ that are smaller than the first diameter $R_1$ of the cylindrical surface 122 of the developing roller 107 so that the second diameter portions do not come in contact with the cylindrical surface 122 of the developing roller 107.

In an embodiment of the present invention, the varied diameter part 108*a* is formed in a taper shape having a frustum-of-cone taper surface 118*a* tapered toward a right end of axis 107*a* of the developing roller 107 to prevent the varied diameter part 108*a* from being in contact with the photosensitive body 109, whereas the matching part 116*a* is formed in a reverse taper shape having a reverse frustum-of-cone taper surface 119*a* conforming to the frustum-of-cone taper surface 118*a*.

The reverse frustum-of-cone taper surface 119*a* of the matching part 116*a* has an extended surface portion 121*a* axially extended from a spot where the reverse frustum-of-cone taper surface 119*a* and the frustum-of-cone taper surface 118*a* cease to make a contact.

The extended surface portion 121*a* may be formed to have a diameter equal to, or a diameter or varied diameter smaller than a third diameter $R_3$ of the reverse frustum-of-cone taper surface 119*a* corresponding to the second diameter portion $R_{2N}$ of the variable diameter $R_2$, positioned at the spot where the reverse frustum-of-cone taper surface 119*a* and the frustum-of-cone taper surface 118*a* cease to make contact.

By the extended surface portion 121*a*, even though a small amount of developer wraparound 117 is generated between the reverse frustum-of-cone taper surface 119*a* and the frustum-of-cone taper surface 118*a*, the wraparound 117 cannot be transferred to the photosensitive body 109, but is withdrawn to the metering roller 115.

The matching part 116*a* may be formed of an elastic material to transmit an elastic contact pressure, wherein the pressure is sufficient in cooperation with the varied diameter part 108*a* to prevent developer wraparoung when the matching part 116*a* comes in contact with the varied diameter part 108*a*.

The matching part 116*a*, 116*b* is inserted into a short jaw part 115*a*, 115*b* formed at the end of the metering roller 115.

To fix the matching part 116*a* to the end of the metering roller 115, after the matching part 116*a*, 116*b* is inserted into the short jaw part 115*a*, 115*b*, a ring type stopper 120*a*, 120*b* is fixed to the end of the metering roller 115 by tightly fitting or by using screws.

The wraparound preventing unit 100*b* shown at the left side of FIG. 6 has the same structure as the wraparound preventing unit 100*a* described above.

The operation of the apparatus 100 to prevent developer wraparound in the wet electrophotographic printer in accordance with the present invention is now explained with reference to FIG. 6.

According to a print command, the liquid developer contained in the storing unit of the developing apparatus 113 is formed as a charged developer layer on the developing roller 107 rotating at a predetermined speed due to an electric force from the deposit roller, and then is formed as a predetermined toner amount of developer layer on the developing roller 107 due to a predetermined voltage from the metering roller 115.

Here, the liquid developer is rotated and pushed toward both side surfaces of the metering roller 115, is intercepted and is not transferred to a developer layer formed on the cylindrical surface 122 after passing the nip between the developing roller 107 and the metering roller 115, along both ends of the developing roller 107 due to elastic contact of the varied diameter parts 108*a* and 108*b* and the matching parts 116*a* and 116*b*.

In addition, although the developer may form a minimal amount of wraparound 117 at both ends of the developing roller 107, since the varied diameter parts 108*a* and 108*b* formed at both ends of the developing roller 107 have the frustum-of-cone taper surfaces 118*a* and 118*b* preventing contact with the photosensitive body 109 and the reverse frustum-of-cone taper surfaces 119*a* and 119*b* of the matching parts 116*a* and 116*b* have the extended surface portions 121*a* and 121*b*, the wraparound 117 is not transferred to the photosensitive body 109, but is withdrawn toward the metering roller 115.

While a predetermined amount or density of developer layer is formed by the deposit roller and the metering roller 115, an electrostatic latent image corresponding to an image to be printed is formed on the photosensitive body 109 by the charged roller and the laser scanning unit.

Thereafter, when the developing roller 107, where the predetermined amount or density of developer layer is formed, is rotated with the photosensitive body 109 on which the electrostatic latent image is formed, the developer layer formed on the developing roller 107 is transferred to the electrostatic latent image formed on the photosensitive body 109 due to a difference of voltage and electrostatic force transmitted to the photosensitive body 109 and the developing roller 107, and is developed as a toner image.

As explained with reference to FIG. 1, the toner image is formed on a paper as a desired image through the sequential image formation process, including transfer and fixation, and residual developer sediments are removed from a transfer belt for transferring the toner image by the cleaning blade, and are collected in a used developer storing unit.

Referring to FIGS. 7A through 7F, there are illustrated modified wraparound preventing units (only left side wraparound preventing units shown) of the apparatus 100 for preventing developer wraparound in accordance with the present invention.

The structure and operation of the modified wraparound preventing units 100*b*', 100*b*", 100*b*'", 100*b*"", 100*b*""" and 100*b*"""" are the same as those of the wraparound preventing unit 100*a* explained with reference to FIG. 6, except that varied diameter parts 108*b*', 108*b*", 108*b*'", 108*b*"", 108*b*""" and 108*b*"""" are constructed respectively in a shape that is tapered in a saw tooth or wave pattern (FIG. 7A), a shape that is tapered in a convex pattern (FIG. 7B), a shape that is tapered in a concave pattern (FIG. 7C), a shape that is tapered in a step pattern (FIG. 7D), a shape that is tapered and bent in a jar pattern (FIG. 7E), and a shape that is tapered in more than a two angled frustum-of-cone pattern (FIG. 7F), and matching parts 116*b*', 116*b*", 116*b*'", 116*b*"", 116*b*""" and 116*b*"""" are constructed in corresponding shapes to come in compressive contact with the varied diameter parts 108*b*', 108*b*", 108*b*'", 108*b*"", 108*b*""" and 108*b*"""", and thus prevent the developer wraparound.

Accordingly, explanation of the structure and operation of the modified wraparound preventing units 100*b*', 100*b*", 100*b*'", 100*b*"", 100*b*""" and 100*b*"""" is omitted.

As discussed above, it can be appreciated that in accordance with the present invention, the apparatus for preventing wraparound in the wet electrophotographic printer installs the varied diameter parts and the matching parts respectively at both ends of the developing roller and both ends of the metering roller to prevent developer wraparound in the developing roller and the photosensitive body during development.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. An apparatus to prevent developer wraparound in a wet electrophotographic printer, comprising:

a developer storing space to store a liquid developer:

a photosensitive body to form a latent image:

a developer transfer body rotated to face the photosensitive body, to transfer the developer from the developer storing space to the photosensitive body to form a visible image according to the latent image, the developer transfer body comprising a first portion having a first diameter which is substantially constant, and a second portion extended beyond at least one of both ends of the first portion along a longitudinal axis of the developer transfer body and having a varied diameter comprising a plurality of second diameter portions smaller than the first diameter: and at least one developing density restricting roller to restrict at least one of an amount and a density of toner particles of the liquid developer supplied per unit area of the developer transfer body, the at least one developing density restricting roller being constructed to have a shape conforming to the developer transfer body, wherein the developer transfer body is formed in a roller shape, and at least a portion of the second portion is tapered at a predetermined angle toward a corresponding end of the developer transfer body to prevent the at least portion of the second portion from being in contact with the photosensitive body, and wherein the developing density restricting roller comprises at least one end portion formed to have a shape conforming to the second portion of the developer transfer body to make a compressive contact therebetween.

2. The apparatus according to claim 1, wherein the at least one end portion of the developing density restricting roller is formed of an elastic material.

3. The apparatus according to claim 1, wherein the second portion is terminated at the second diameter portion of the varied diameter positioned at a spot where the second portion and the at least one end portion of the developing density restricting roller cease to make a contact, and the at least one end portion of the developing density restricting roller comprises an extended surface portion formed to have one of a diameter equal to, a diameter smaller than, and a varied diameter smaller than a third diameter of the at least one end portion of the developing density restricting roller corresponding to the second diameter portion of the varied diameter positioned at the spot where the second portion and the at least one end portion of the developing density restricting roller cease to make a contact.

4. An apparatus to prevent developer wraparound in a wet electrophotographic printer, comprising:

a developer storing space to store a liquid developer:

a photosensitive body to form a latent image:

a developer transfer body rotated to face the photosensitive body, to transfer the developer from the developer storing space to the photosensitive body to form a visible image according to the latent image, the developer transfer body comprising a first portion having a first diameter which is substantially constant, and a second portion extended beyond at least one of both ends of the first portion along a longitudinal axis of the developer transfer body and having a varied diameter comprising a plurality of second diameter portions smaller than the first diameter: and at least one developing density restricting roller to restrict at least one of an amount and a density of toner particles of the liquid developer supplied per unit area of the developer transfer body, the at least one developing density restricting roller being constructed to have a shape conforming to the developer transfer body, wherein the developer transfer body is formed in a roller shape, and at least a portion of the second portion is formed to have a shape selected from a shape that is tapered in a saw tooth pattern, a shape that is tapered in a convex pattern, a shape that is tapered in a concave pattern, a shape that is tapered in a step pattern, a shape that is tapered and bent in a jar pattern, and a shape that is tapered in more than a two angled frustum-of-cone pattern.

5. The apparatus according to claim 4, wherein the developing density restricting roller comprises at least one end portion formed to have a shape conforming to the second portion of the developer transfer body to make a compressive contact therebetween.

6. The apparatus according to claim 5, wherein the at least one end portion of the developing density restricting roller is formed of an elastic material.

7. The apparatus according to claim 5, wherein the second portion is terminated at the second diameter portion of the varied diameter positioned at a spot where the second portion and the at least one end portion of the developing density restricting roller cease to make a contact, and the at least one end portion of the developing density restricting roller comprises an extended surface portion formed to have one of a diameter equal to, a diameter smaller than, and a varied diameter smaller than a third diameter of the at least one end portion of the developing density restricting roller corresponding to the second diameter portion of the varied diameter positioned at the spot where the second portion and the at least one end portion of the developing density restricting roller cease to make a contact.

8. An apparatus preventing developer wraparound in a wet electrophotographic printer, comprising:

a photosensitive body to form a latent image;

a developer transfer body proximate to the photosensitive body, to transfer liquid developer to the photosensitive body to form a visible image according to the latent image, the developer transfer body comprising a main portion having a first diameter which is substantially constant, and cone shaped end portions extended beyond ends of the main portion longitudinally; and at least one metering roller contiguous with the developer transfer body, to restrict at least one of an amount and a density of toner particles of the liquid developer supplied per unit area of the developer transfer body.

9. The apparatus according to claim 8, wherein the developer transfer body is formed in a roller shape.

10. The apparatus according to claim 9, wherein the metering roller makes a compressive contact with at least a portion of the main portion of the developer transfer body.

11. The apparatus according to claim 10, wherein at least one end portion of the metering roller is formed of an elastic material.

12. The apparatus according to claim 11, wherein the main portion of the developer transfer body is terminated at a spot where the metering roller and the developer transfer body cease to make a contact, and at least one of the cone shaped end portions of the developer transfer body comprises a modified shape.

13. The apparatus according to claim 12, wherein the developer transfer body is formed in a roller shape, and the modified shape of at least a portion of at least one of the cone shaped end portions comprises a shape selected from a shape that is tapered in a saw tooth pattern, a shape that is tapered in a convex pattern, a shape that is tapered in a concave pattern, a shape that is tapered in a step pattern, a shape that is tapered and bent in a jar pattern, and a shape that is tapered in more than a two angled frustum-of-cone pattern.

14. The apparatus according to claim 13, wherein the metering roller comprises at least one end portion formed to have a shape conforming to the modified shape of the at least one cone shaped end portion of the developer transfer body to make a compressive contact therebetween.

15. The apparatus according to claim 14, wherein the at least one end portion of the metering roller is formed of an elastic material.

16. The apparatus according to claim 14, wherein the at least one cone shaped end portion of the developing transfer body has a modified shape and is terminated at a spot where the at least one cone shaped end portion and the at least one end portion of the metering roller having a shape conforming to the modified shape of the at least one cone shaped end portion of the developer transfer body cease to make a contact.

17. A device to inhibit developer wraparound in a wet electrophotograhic printer, comprising:

a frustum of a cone tapered first end unit of a developing roller; and a reverse frustum of a cone tapered surface of a metering roller, arranged to mate with the frustum of the cone tapered first end unit of the developing roller, to inhibit developer wraparound formation on the developing roller.

18. The device of claim 17, wherein the frustum of the cone tapered first end unit is shaped in one of: a cone shape, a shape tapered in a saw tooth pattern, a shape that is tapered in a convex pattern, a shape that is tapered in a concave pattern, a shape that is tapered in a step pattern, a shape that is tapered and bent in a jar pattern, and a shape that is tapered in more than a two angled frustum-of-cone pattern, wherein the reverse frustum of the cone tapered surface of the metering roller is shaped to mate with the shape selected for the frustum of the cone tapered first end unit.

* * * * *

UNITED STATES PATENT AND TRADEMARK OFFICE

CERTIFICATE OF CORRECTION

PATENT NO. : 7,113,730 B2
APPLICATION NO. : 10/610797
DATED : September 26, 2006
INVENTOR(S) : Geun-Yong Park et al.

It is certified that error appears in the above-identified patent and that said Letters Patent is hereby corrected as shown below:

Column 8, Line 61, change “developer:” to --developer;--

Column 8, Line 62, change “image:” to --image;--

Column 9, Line 6, change “diameter:” to --diameter;--

Column 9, Line 44, change “developer:” to --developer;--

Column 9, Line 45, change “image:” to --image;--

Column 9, Line 56, change “diameter:” to --diameter;--

Column 11, Line 15, “electrophotograhic” to --electrophographic--

Signed and Sealed this

Sixth Day of March, 2007

JON W. DUDAS
*Director of the United States Patent and Trademark Office*

UNITED STATES PATENT AND TRADEMARK OFFICE

CERTIFICATE OF CORRECTION

PATENT NO. : 7,113,730 B2
APPLICATION NO. : 10/610797
DATED : September 26, 2006
INVENTOR(S) : Geun-Yong Park et al.

It is certified that error appears in the above-identified patent and that said Letters Patent is hereby corrected as shown below:

Column 8, Line 61, change “developer:” to --developer;--

Column 8, Line 62, change “image:” to --image;--

Column 9, Line 6, change “diameter:” to --diameter;--

Column 9, Line 44, change “developer:” to --developer;--

Column 9, Line 45, change “image:” to --image;--

Column 9, Line 56, change “diameter:” to --diameter;--

Column 11, Line 15, “electrophotograhic” to --electrophotographic--

This certificate supersedes Certificate of Correction issued March 6, 2007.

Signed and Sealed this

Twelfth Day of June, 2007

JON W. DUDAS
*Director of the United States Patent and Trademark Office*